US008322416B2

(12) United States Patent
Pop et al.

(10) Patent No.: US 8,322,416 B2
(45) Date of Patent: Dec. 4, 2012

(54) FOCUSED SAMPLING OF FORMATION FLUIDS

(75) Inventors: Julian J. Pop, Houston, TX (US); Pierre-Yves Corre, Eu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 617 days.

(21) Appl. No.: 12/486,804

(22) Filed: Jun. 18, 2009

(65) Prior Publication Data

US 2010/0319912 A1 Dec. 23, 2010

(51) Int. Cl.
*E21B 49/08* (2006.01)
*E21B 49/10* (2006.01)

(52) U.S. Cl. ..... 166/264; 166/250.17; 166/100

(58) Field of Classification Search ..... 166/265, 166/264, 100, 250.17, 54.1, 191
See application file for complete search history.

(56) References Cited

U.S. PATENT DOCUMENTS

| | | | | |
|---|---|---|---|---|
| 2,511,759 | A | | 6/1950 | Williams |
| 2,581,070 | A | | 1/1952 | Blood |
| 2,978,046 | A | * | 4/1961 | True ..... 175/233 |
| 3,181,608 | A | | 5/1965 | Palmer |
| 3,934,468 | A | | 1/1976 | Brieger |
| 4,860,580 | A | * | 8/1989 | DuRocher ..... 73/152.26 |
| 4,860,581 | A | | 8/1989 | Zimmerman et al. |
| 4,893,505 | A | | 1/1990 | Marsden et al. |
| 4,936,139 | A | | 6/1990 | Zimmerman et al. |
| 4,951,749 | A | | 8/1990 | Carroll |
| 5,113,953 | A | | 5/1992 | Noble |
| 5,265,682 | A | | 11/1993 | Russell et al. |
| 5,520,255 | A | | 5/1996 | Barr et al. |
| 5,553,678 | A | | 9/1996 | Barr et al. |
| 5,553,679 | A | | 9/1996 | Thorp |
| 5,582,259 | A | | 12/1996 | Barr |
| 5,603,385 | A | | 2/1997 | Colebrook |
| 5,622,223 | A | | 4/1997 | Vasquez |
| 5,673,763 | A | | 10/1997 | Thorp |
| 5,685,379 | A | | 11/1997 | Barr et al. |
| 5,695,015 | A | | 12/1997 | Barr et al. |
| 5,706,905 | A | | 1/1998 | Barr |
| 5,778,992 | A | | 7/1998 | Fuller |
| 5,789,669 | A | | 8/1998 | Flaum |
| 5,803,185 | A | | 9/1998 | Barr et al. |
| 5,803,186 | A | | 9/1998 | Berger et al. |
| 5,971,085 | A | | 10/1999 | Colebrook |
| 6,089,332 | A | | 7/2000 | Barr et al. |
| 6,092,666 | A | | 7/2000 | Clark et al. |
| 6,158,529 | A | | 12/2000 | Dorel |
| 6,244,361 | B1 | | 6/2001 | Comeau et al. |
| 6,301,959 | B1 | | 10/2001 | Hrametz et al. |
| 6,364,034 | B1 | | 4/2002 | Schoeffler |
| 6,394,193 | B1 | | 5/2002 | Askew |
| 6,401,842 | B2 | | 6/2002 | Webb et al. |

(Continued)

*Primary Examiner* — Daniel P Stephenson
(74) *Attorney, Agent, or Firm* — John Vereb

(57) ABSTRACT

An apparatus for obtaining a fluid at a position within a wellbore that penetrates a subterranean formation includes a body adapted to be disposed in the wellbore on a conveyance equipped with one or more expandable packers providing a sample region disposed between an upper cleanup zone and a lower cleanup zone when expanded into abutting contact with the wellbore wall. An upper cleanup port is provided at the upper cleanup zone. A lower cleanup port is provided at the lower cleanup zone. A fluid cleanup flowline in fluid connection with the upper and lower cleanup ports can be provided. A sampling inlet is provided at the sampling region, and a sampling flowline is in fluid connection with the sampling inlet for drawing fluid from the sampling region.

18 Claims, 6 Drawing Sheets

U.S. PATENT DOCUMENTS 6,585,045 B2 7/2003 Lee et al.
6,609,568 B2 8/2003 Krueger et al.
6,722,432 B2 * 4/2004 Spiers et al. ..... 166/264
6,964,301 B2 11/2005 Hill et al.
7,090,012 B2 8/2006 Hill et al.
7,178,591 B2 2/2007 Del Campo et al.
7,296,462 B2 11/2007 Gregory et al.
7,866,387 B2 * 1/2011 van Zuilekom et al. ..... 166/265
2007/0215348 A1 9/2007 Corre et al.

* cited by examiner

FOCUSED SAMPLING OF FORMATION FLUIDS

BACKGROUND OF THE DISCLOSURE

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and also carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are essential to predicting the production capacity and production lifetime of a subsurface formation.

One technique for measuring formation and reservoir fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include one or more probes that may be pressed against the wellbore wall to establish fluid communication with the formation. This type of wireline tool is often called a "formation tester." Using the probe(s), a formation tester measures the pressure history of the formation fluids contacted while generating a pressure pulse, which may subsequently be used to determine the formation pressure and formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip". Further, the wireline tools must be lowered to the zone of interest, commonly at or near the bottom of the wellbore. The combination of removing the drill string and lowering the wireline tool downhole are time-consuming procedures and can take up to several hours, if not days, depending upon the depth of the wellbore. Because of the great expense and rig time required to "trip" the drill pipe and lower the wireline tools down the wellbore, wireline tools are generally used only when the information is absolutely needed or when the drill string is tripped for another reason, such as to change the drill bit or to set casing, etc. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling).

MWD typically refers to measuring the drill bit trajectory as well as wellbore temperature and pressure, while LWD refers to measuring formation parameters or properties, such as resistivity, porosity, pressure and permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making a seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568, and 6,964,301.

Reservoir evaluation can be performed on fluids drawn into the downhole tool while the tool remains downhole. Techniques currently exist for performing various measurements, pretests and/or sample collection of fluids that enter the downhole tool. However, it has been discovered that when the formation fluid passes into the downhole tool, various contaminants, such as wellbore fluids and/or drilling mud primarily in the form of mud filtrate from the "invaded zone" of the formation or through a leaky mudcake, may enter the tool with the formation fluids. The invaded zone is the portion of the formation radially beyond the mudcake layer lining the wellbore where mud filtrate has penetrated the formation leaving the (somewhat solid) mudcake layer behind. These mud filtrate contaminates may affect the quality of measurements and/or samples of formation fluids. Moreover, severe levels of contamination may cause costly delays in the wellbore operations by requiring additional time for obtaining test results and/or samples representative of formation fluid. Additionally, such problems may yield false results that are erroneous and/or unusable in field development work. Thus, it is desirable that the formation fluid entering into the downhole tool be sufficiently "clean" or "virgin". In other words, the formation fluid should have little or no contamination.

Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid. Additionally, as shown in U.S. Pat. No. 6,301,959, a probe is provided with a guard ring to divert contaminated fluids away from clean fluid as it enters the probe. More recently, U.S. Pat. No. 7,178,591 discloses a central sample probe with an annular "guard" probe extending about an outer periphery of the sample probe, in an effort to divert contaminated fluids away from the sample probe.

Despite the existence of techniques for performing formation evaluation and for attempting to deal with contamination, there remains a need to manipulate the flow of fluids through the downhole tool to reduce contamination as it enters and/or passes through the downhole tool. It is desirable that such techniques are capable of diverting contaminants away from clean fluid.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
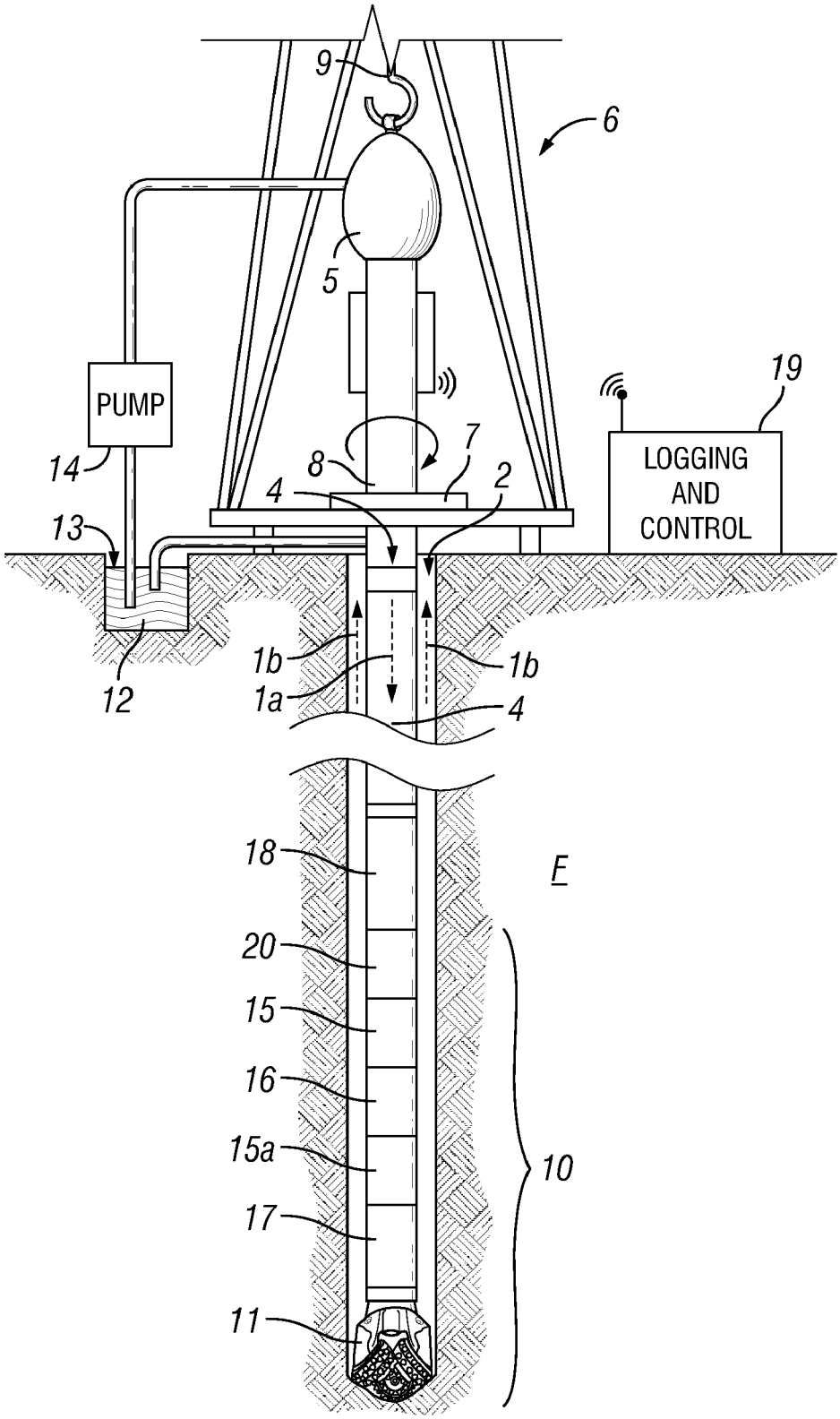
FIG. 1 illustrates an embodiment of a formation fluid sampling tool of the present invention utilized in a drill string.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 illustrates a well system in which the present invention can be employed. The well can be onshore or offshore. In this exemplary system, a borehole or wellbore 2 is formed in a subsurface formation(s), generally denoted as F, by rotary drilling in a manner that is well known. Embodiments of the invention can also use directional drilling, as will be described hereinafter.

A drill string 4 is suspended within the wellbore 2 and has a bottomhole assembly 10 which includes a drill bit 11 at its lower end. The surface system includes a deployment assembly 6, such as a platform, derrick, rig, and the like, positioned over wellbore 2. In the embodiment of FIG. 1, assembly 6 includes a rotary table 7, kelly 8, hook 9 and rotary swivel 5. Drill string 4 is rotated by the rotary table 7, energized by means not shown, which engages the kelly 8 at the upper end of the drill string. Drill string 4 is suspended from hook 9, attached to a traveling block (not shown), through kelly 8 and rotary swivel 5 which permits rotation of the drill string relative to the hook. As is well known, a top drive system can alternatively be used.

In the example of this embodiment, the surface system further includes drilling fluid or mud 12 stored in a pit 13 or tank at the wellsite. A pump 14 delivers drilling fluid 12 to the interior of drill string 4 via a port in swivel 5, causing the drilling fluid to flow downwardly through drill string 4 as indicated by the directional arrow 1*a*. The drilling fluid exits drill string 4 via ports in the drill bit 11, and then circulates upwardly through the annulus region between the outside of the drill string and the wall of the wellbore, as indicated by the directional arrows 1*b*. In this well known manner, the drilling fluid lubricates drill bit 11 and carries formation cuttings up to the surface as it is returned to pit 13 for recirculation.

Bottomhole assembly ("BHA") 10 of the illustrated embodiment includes a logging-while-drilling ("LWD") module 15, a measuring-while-drilling ("MWD") module 16, a rotary-steerable system and motor 17, and drill bit 11.

LWD module 15 is housed in a special type of drill collar, as is known in the art, and can contain one or a plurality of known types of logging tools. It will also be understood that more than one LWD and/or MWD module can be employed, e.g., as represented generally at 15A. (References, throughout, to a module at the position of 15 can alternatively mean a module at the position of 15A as well.) LWD module includes capabilities for measuring, processing, and storing information, as well as for communicating with the surface equipment. In the present embodiment, the LWD module includes a pressure measuring sensor and a flow rate sensor.

MWD module 16 is also housed in a special type of drill collar, as is known in the art, and can contain one or more devices for measuring characteristics of the drill string and drill bit. BHA 10 may further include an apparatus (not shown) for generating electrical power to the downhole system. This may typically include a mud turbine generator powered by the flow of the drilling fluid, it being understood that other power and/or energy storage systems, for example batteries or fuel cells, etc., may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

In this embodiment, BHA 10 includes a surface/local communications module or package as generally denoted as 18. Communications module 18 can provide a communications link between a controller 19, the downhole tools, sensors and the like. In the illustrated embodiment, controller 19 is an electronics and processing package that can be disposed at the surface. Electronic package and processors for storing, receiving, sending, and/or analyzing data and signals may be provided at one or more of the modules as well.

Controller 19 can be a computer-based system having a central processing unit ("CPU"). The CPU may be a microprocessor based device operatively coupled to a memory, as well as an input device and an output device. The input device may comprise a variety of devices, such as a keyboard, mouse, voice-recognition unit, touch screen, other input devices, or combinations of such devices. The output device may comprise a visual and/or audio output device, such as a monitor having a graphical user interface. Additionally, the processing may be done on a single device or multiple devices. Controller 19 may further include transmitting and receiving capabilities for inputting or outputting signals.

A particularly advantageous use of the system hereof is in conjunction with controlled steering or "directional drilling." In this embodiment, a rotary-steerable subsystem 17 (FIG. 1) is provided. Directional drilling is the intentional deviation of the wellbore from the path it would naturally take. In other words, directional drilling is the steering of the drill string so that it travels along a desired path. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated wellbores into the earth may be generally classified as either "point-the-bit" systems or "push-the-bit" systems. In the point-the-bit system, the axis of rotation of the drill bit is deviated from the local axis of the bottomhole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Pat. Nos. 6,401,842; 6,394,193; 6,364,034; 6,244,361; 6,158,529; 6,092,666; and 5,113,953 all herein incorporated by reference. In the push-the-bit rotary steerable system there is usually no specially identified mechanism to deviate the bit axis from the local bottomhole assembly axis. Instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

In the embodiment illustrated in FIG. 1, BHA 10 further includes a sampling tool or module 20 according to one or more aspects described in further detail below. Although sampling tool 20 may be considered an LWD device or module in some embodiments, it is identified separately herein for purposes of description.

Figure 2:
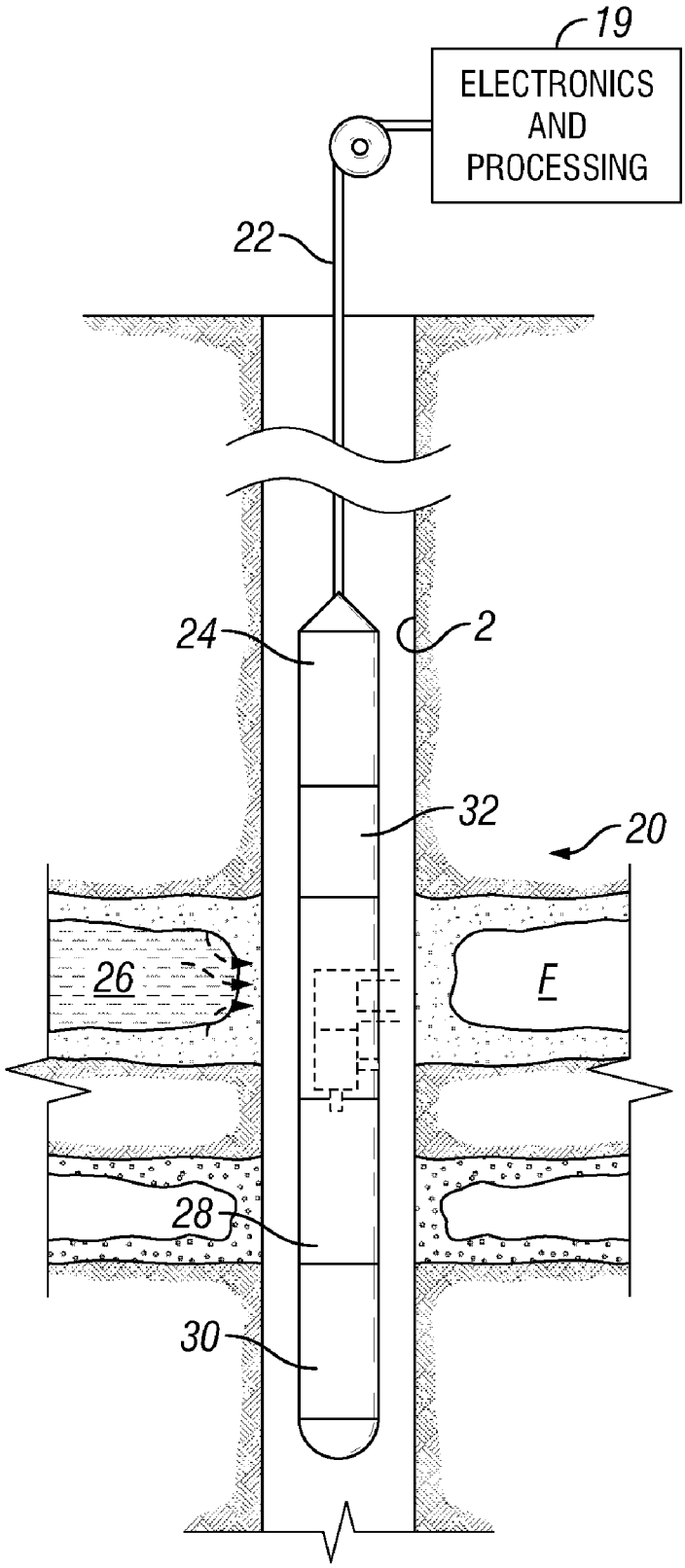
FIG. 2 is schematic view of an embodiment of a formation fluid sampling tool of the present invention deployed on a wireline.

Referring to FIG. 2, an example sampling tool 20 is deployed in a well as a wireline tool, thus being suspended in wellbore 2 on a cable 22 which has contained within it at least one conductor and which is spooled at the Earth's surface. At the surface, cable 22 is communicatively coupled to electronics and processing system 19. Tool 20 may further include a downhole communications and/or electronics package as illustrated in FIG. 1.

Sampling tool 20, which may be identified as a formation tester, is configured to seal off or isolate one or more portions of a wall of wellbore 2 to fluidly couple to the adjacent formation F and/or to draw fluid samples from formation F. Accordingly, sampling tool 20 may include one or more expandable members to form a sampling region into which formation fluid 26 may be drawn into sampling tool 20. In some embodiments, thusly drawn formation fluid 26 may be expelled through a port to the wellbore or sent to one or more fluid collecting chambers 28 and 30. Other components (32) such as, and without limitation, pumps, such as drawdown pumps and downhole pumps for inflating packers, drawdown pistons, pressure containers, electronics, power sources, and the like may further be disposed within body 24. In the illustrated example, controller 19 and/or a downhole control system are configured to control operations of sampling tool 20 and/or the drawing of a fluid sample from formation F.

Figure 3:
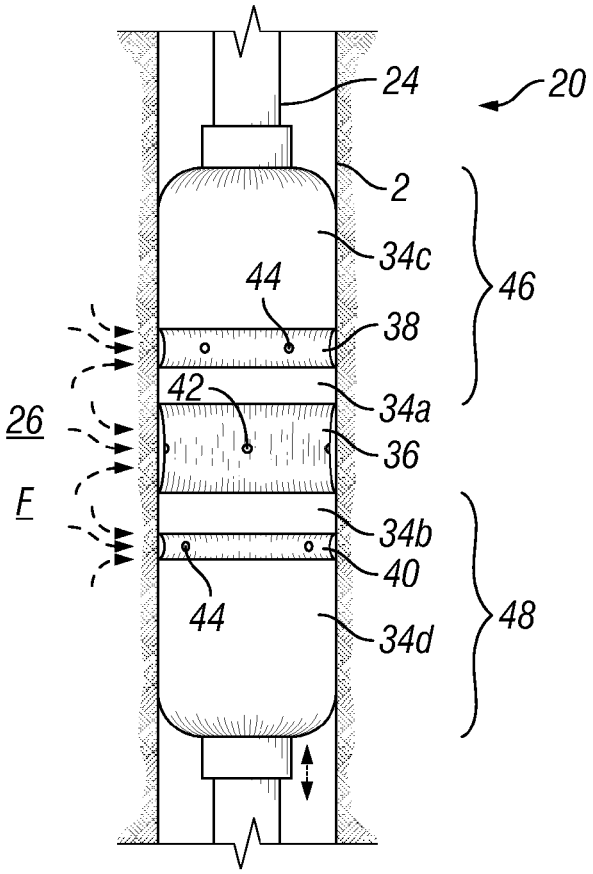
FIG. 3 is a conceptual illustration of a formation fluid sampling tool according to embodiments of the present invention.

Referring to FIG. 3, a conceptual illustration of an embodiment of sampling tool 20 is illustrated in isolation in a wellbore 2. In this embodiment, sampling tool 20 is a focused sampling tool comprising a tool body 24 having one or more expandable packers 34, a sample region 36, and opposing cleanup zones 38, 40 positioned on opposing sides of sample region 36. In this example, cleanup zone 38 is positioned above sample region 36 and cleanup zone 40 is positioned below sample region 36 relative to the surface of the well (FIGS. 1 and 2). The packers 34 may not be inflatable, but may instead be mechanically set, such as in a manner similar to production packers. Sampling tool 20 provides a sampling inlet or port 42 in fluid communication with sample region 36. Sampling tool 20 further provides cleanup inlets or ports 44 positioned at cleanup zones 38 and 40. As described further below, each port 42, 44 is connected to a flowline for passing the respective clean formation fluid 26 and waste fluid from their respective intervals to a point of disposal which may be located within the tool or outside of the tool. One or more of the flowlines 54, 56 may be in communication with a sensor 62, for example an optical fluid analyzer, to evaluate the fluid passing therethrough (see, e.g., FIG. 6).

Packer 34 is an expandable packer that extends radially outward from body 24 to abut and seal against the wall of wellbore 2. Packer 34 may be formed of various materials and in various configurations. For example, a packer may include a first collar affixed to body 24 and a second collar slidably coupled to body 24 and an elastomeric material positioned thereon. The expandable material may comprise or be disposed with a bladder that can be inflated upon the introduction of a pressurized fluid. In some embodiments, packer 34 may be expandable by means other than inflation. Packer 34 may include one or more layers of elastomeric material, reinforcement cables, slats and the like.

When packer(s) 34 is expanded, by inflation or other means, into abutting contact with the wall of wellbore 2, a void or open area is defined between the wall of the wellbore and tool 20 at sample region 36 and cleanup zones 38, 40. For purposes of description herein, the void or area formed and the physical member are referred to by the same denotation. For example, sample region 36 is utilized to define a physical portion of tool 20 and the isolated volume formed at sample region 36 when packer(s) 34 is expanded. Similarly, cleanup zones 38 and 40 can refer to a linear portion of tool 20 as well as a void or open area formed at that portion of tool 20.

Sampling region 36 and cleanup zones 38, 40 are isolated from one another when the one or more packers are actuated and expanded radially outward to the wall of the wellbore. Sampling region 36 is defined by an upper sample packer section 34*a* and a lower sample packer section 34*b*. In some embodiments, a toroidal shaped sample region 36 is formed substantially around the circumference of wellbore 2 upon the expansion of packer(s) 34. Similar to sample region 36, cleanup zone 38 is defined by an upper guard packer section 34*c* and upper sample packer section 34*a*, and cleanup zone 40 is defined by lower sample packer section 34*b* and a lower guard packer section 34*d*.

When positioned at the zone of interest and activated, sampling tool 20 forms sampling region 36 that is isolated from the rest of the wellbore by an upper guard interval 46 and a lower guard interval 48. Upper guard interval 46 includes upper guard packer section 34*c*, cleanup zone 38, and upper sample packer section 34*a*. Lower guard interval 48 includes lower sample packer section 34*b*, cleanup zone 40, and lower guard packer section 34*d*.

Figure 4:
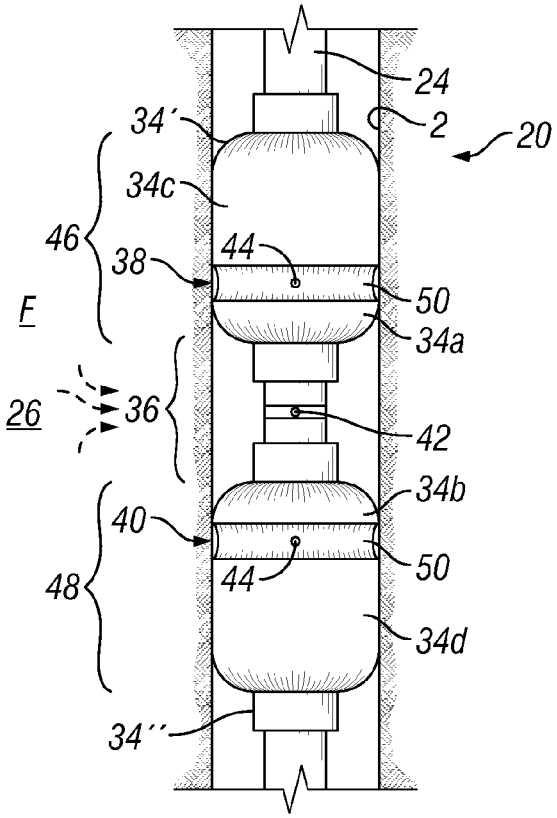
FIG. 4 is an elevation view of an embodiment of a formation fluid sampling tool shown in isolation and disposed in a wellbore.

It is noted that packer sealing portions 34*a*, 34*b*, 34*c*, and 34*d* may have different lengths from one another. The relative lengths may be selected utilizing well and formation criteria. For example, as illustrated in FIGS. 3 and 4, guard packer sections 34*c* and 34*d* have axial lengths longer than sample packer sections 34*a* and 34*b*. The relatively shortened axial length of sample packer sections 34*a* and 34*b* may facilitate shortening the length of tool 20. This embodiment may be facilitated, for example, when the pressures in cleanup zones 38 and 40 and sampling region 36 are substantially equal. It is also identified that the axial width and the area of sample region 36 may be varied for certain well conditions. For example, sample region 36 is illustrated as having a relatively large axial width in FIGS. 3 and 4 relative to that in FIG. 5. It may be desired to reduce the cross-sectional area of sampling region 36, for example where wellbore fluid is not displaced upon expansion of packer(s) 34 and/or wellbore fluid continuously contaminates sample region 36.

As described above, sample region 36 and guard intervals 46 and 48 may be formed by one or more expandable packers 34 as is generally denoted by the hatched lines extending between packer portions 34*a*, 34*b*, 34*c*, and 34*d*.

Fluid connections between cleanup ports 44 and sampling ports 42 and cleanup flowline 54 and sampling flowline 56 contained within body 24 may be made by methods well known in the art, for example, rigid telescopic conduits, rigid hinged conduits and/or flexible conduits.

Figure 3C:
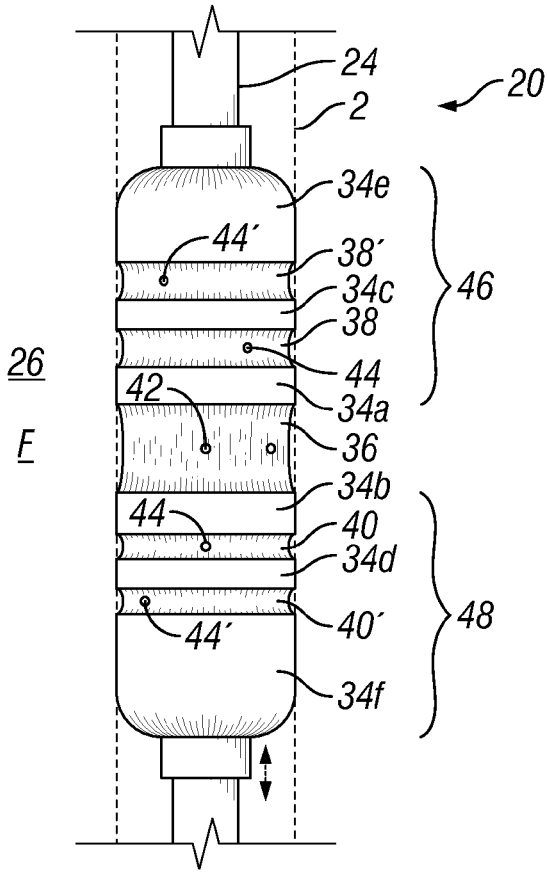
FIG. 3*c* is a conceptual illustration of an embodiment of the tool shown in FIG. 3.
Figure 3A:
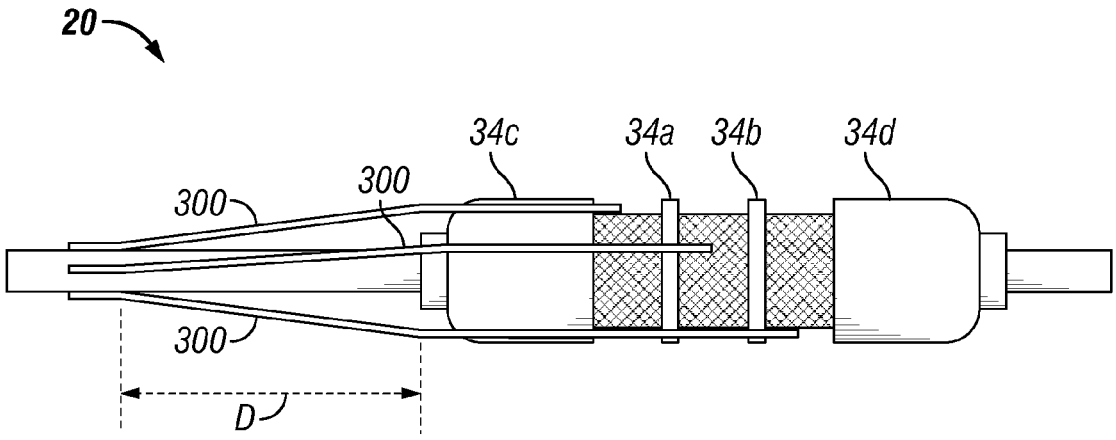
FIG. 3*a* is a conceptual illustration of an embodiment of the tool shown in FIG. 3.

Referring to FIG. 3*a*, an embodiment of formation fluid sampling tool 20 is illustrated disposed in wellbore 2. In this embodiment, the fluid connections between cleanup ports 44 and sampling ports 42 and cleanup flowline 54 and sampling flowline 56 consist of one or more tubes 300 located external to the body 24 and make fluid connection with the body 24 outside of the profile of the packer(s). The tubes 300 may be bonded in or to an outer rubber layer for sealing. A distance D may be configured so as to minimize bending of the tubes 300.

Figure 3B:
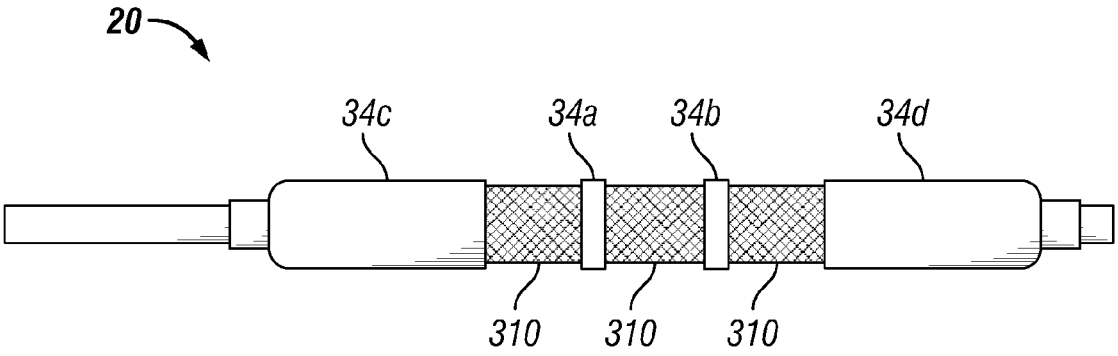
FIG. 3*b* is a conceptual illustration of an embodiment of the tool shown in FIG. 3.

Referring to FIG. 3*b*, another embodiment of formation fluid sampling tool 20 is shown. In this embodiment, a plurality of filters 310 are positioned at intervals between the different packer sealing portions 34*a-d*.

Referring to FIG. 3*c*, an embodiment of formation fluid sampling tool 20 is illustrated disposed in wellbore 2. In this alternate embodiment, the upper guard section 46 is comprised of two guard intervals 38, 38' and the lower guard section 48 is also comprised of two guard intervals 40, 40'. This particular embodiment may be advantageous when it is desired to limit the pressure differential across any part of the packer making a seal with the wellbore 2. For example, by adjusting the pressure in guard interval 38 to be intermediate between the pressures in sampling interval 36 and guard interval 38' the pressure difference across upper packer sample section 34*a* can be minimized or otherwise controlled.

Referring to FIG. 4, an embodiment of formation fluid sampling tool 20 is illustrated disposed in wellbore 2. In this embodiment, upper guard interval 46 is provided by a first expandable packer 34' and lower guard interval 48 is provided by a second expandable packer 34". Upper guard interval 46 and lower guard interval 48 will now be described with reference to upper guard interval 46.

Referring to upper guard interval 46, upper guard packer section 34*c* and upper sample packer section 34*a* are formed by and upon the expansion of packer 34'. Cleanup zone 38 is defined by a section of packer 34' that is not expanded radially to the diameter that sections 34*c* and 34*a* are expanded. In some embodiments, a member 50 may be positioned about the packer to prevent the full radial expansion of the packer. For example, member 50 may be a retaining means such as one or more cords, bands, slats or the like to prevent the expansion of that portion of the packer. In some embodiments, the packer may be constructed of a material that expands in response to temperature, heat, or chemical, for example. The portion of the packer to form zone 38 may be constructed of a material that has a reduced radial expansion. The reduced tendency to expand may be provided by the type of material and/or the initial outer diameter of the material.

Cleanup port 44 is provided through packer 34' in cleanup zone 38. Packers 34' and 34" are spaced apart to form sampling zone 36. Sampling port 42 is illustrated in this embodiment as being formed through body 24 at sampling region 36.

Figure 5:
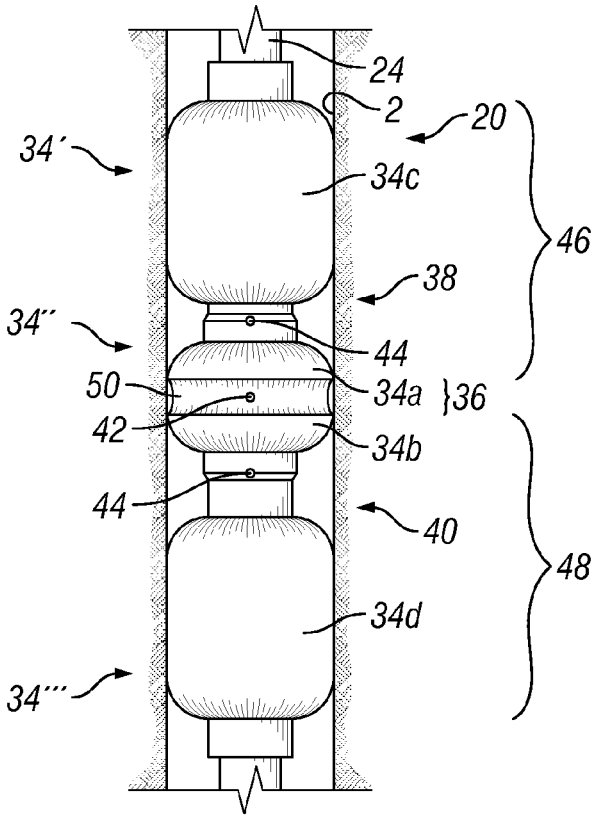
FIG. 5 is an elevation view of another embodiment of a formation fluid sampling tool shown in isolation and disposed in a wellbore.

Referring to FIG. 5, another embodiment of sampling tool 20 comprising three expandable packers is shown positioned in wellbore 2. Upper expandable packer 34' forming upper guard packer section 34*c* is operationally disposed on body 24. A second, or middle, packer 34" is spaced apart from and disposed below upper packer 34' to define upper cleanup zone 38 therebetween. A cleanup port 44 is disposed through body 24 at cleanup zone 38. A third packer 34'" is disposed on body 24 below and spaced apart from second packer 34" to form cleanup zone 40. A cleanup port 44 is provided at cleanup zone 40.

In this embodiment, middle packer 34" provides upper and lower sample packer sections 34*a*, 34*b* and sampling region 36. In this embodiment, sample region 36 does not expand to the radial diameter that sample packer sections 34*a* and 34*b* extend to provide a toroidally shaped sampling region 36 about body 24. Sample region 36 may be constructed in various manners, such as described above, to restrict or limit the radial expansion relative to the opposing sample packer sections 34*a* and 34*b*.

Figure 6:
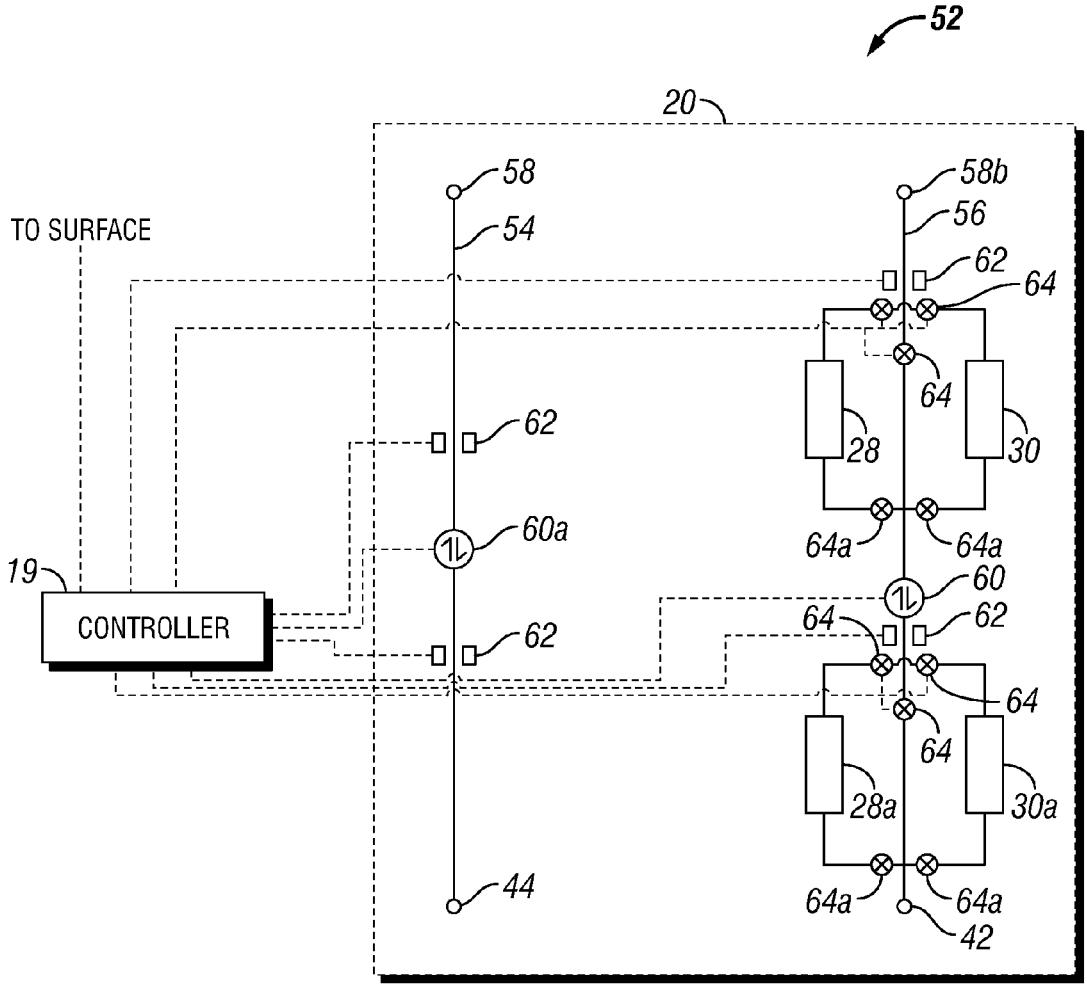
FIG. 6 is a schematic diagram of a hydraulic and electronic circuit of an embodiment of the formation fluid sampling system of the present invention.

Referring to FIG. 6, illustrated is an embodiment of a hydraulic and electronic circuit diagram of sampling tool 20, generally denoted by the numeral 52. Circuit 52 may be provided in one or more modules of sampling tool 20. Circuit 52 may include controller 19, cleanup flowlines 54 and sample flowlines 56. In the illustrated embodiment, cleanup flowline 54 extends from cleanup port 44 to a discharge port 58. Sample flowline 56 may be in fluid connection between sample port 42 and one or more sample chambers 28, 28*a* and 30, 30*a* via valves 64. The sample chambers may be provided on one or both sides of a pump 60. Pump 60 may be provided in flowline 56 to draw fluid into port 42. A pump 60*a* may be in fluid connection with cleanup flowline 58 as well. Pumps 60 and 60*a* may be bidirectional pumps. In some embodiments, a single pump 60 may be connected to all or some of the flowlines.

Circuit 52 may include one or more fluid sensors 62 operationally connected with sample flowlines 56 and or cleanup flowlines 58. Examples of fluid sensors 62 include, without limitation, chemical sensors, optical fluid analyzers, optical spectrometers, nuclear magnetic resonance devices—more generally, devices which yield information relating to the composition of the pumped fluid—devices which measure the thermodynamic properties of the fluid, conductivity meters, density meters, viscometers, flow and volume measuring meters, and pressure and temperature sensors. In the illustrated embodiments, duplicate devices such as sensors 62 and sample chambers 28 and 30 are illustrated on both sides of the pump. Phase and property changes in the fluid occurring across the pump may provide a desire for the duplicate sensors and or sampling chambers.

An example of a method of operating sampling tool 20 is now described with reference to FIGS. 1 through 6. Sampling tool 20 is deployed in wellbore 2 via a conveyance, e.g., drill string 4 or wireline cable 22 or a tubing such as a coiled tubing (not shown), and is positioned adjacent a zone of interest of formation F. Packer(s) 34 are actuated to expand into abutting contact with the wall of wellbore 2. In some embodiments, fluid is first drawn into one of either the cleanup zones 38, 40 or the sampling zone 36 until it is confirmed that a seal has been established between a particular zone(s) and the wellbore wall 2 and, in addition, there is pressure isolation between the cleanup zones 38,40 and the sample zone 36. Upon confirmation of a seal and pressure isolation, fluid is extracted from the other zone until a seal with that zone and the wellbore wall 2 and pressure isolation with the other zone have been confirmed. Fluid may then be drawn into cleanup ports 44 at cleanups zones 38, 40 and sampling port 42 at sampling zone 36 by pumps 60, 60*a*. The rates at which fluid is extracted at cleanup zones 38, 40 and sampling zone 36 may be manipulated as dictated by measurements made at fluid sensors 62 in cleanup flowline 54 and sampling flowline 56 to achieve an optimal rate of fluid cleanup and quality at sampling zone 36. Upon determination that the fluid flowing through sampling flowline 56 is representative of a desired fluid 26, sample chambers 28, 30 may be filled with fluid 26 and sealed with seal valves 64*a*. In some embodiments, fluid is first drawn into cleanup ports 44 and analyzed via sensors 62 in cleanup flowline 54. Upon determination that the fluid flowing through flowline 54 is representative of a desired fluid 26, drawing may commence through sampling port 42 for further testing and analysis.

In some embodiments that include more than one packer 34, for example the embodiment illustrated in FIG. 5, it may be desired to expand one packer after one or more of the other packers have been set in place. For example, in the embodiment of FIG. 5, it may be desired to expand middle packer 34" after pumping or drawing of fluid from cleanup ports 44 has begun. In this manner, it may be desired to expand packer 34" when clean formation fluid 26 is being drawn to further isolate sampling region 36 from contamination.

Accordingly, apparatuses and methods for conducting formation evaluations and for obtaining clean formation fluids are provided. One embodiment of an apparatus for obtaining a fluid at a position within a wellbore that penetrates a subterranean formation includes a body adapted to be disposed in the wellbore on a conveyance equipped with one or more expandable packers providing a sample region disposed between an upper cleanup zone and a lower cleanup zone when expanded into abutting contact with the wellbore wall; an upper cleanup port provided at the upper cleanup zone; a lower cleanup port provided at the lower cleanup zone; at least one fluid cleanup flowline in fluid connection with the upper and lower cleanup ports; a sampling inlet provided at the sampling region; and a sampling flowline in fluid connection with the sampling inlet for drawing fluid from the sampling region.

An exemplary embodiment of a formation fluid sampling tool for obtaining a fluid at a position within a wellbore that penetrates a subterranean formation includes a body adapted to be disposed in the wellbore on a conveyance; one or more expandable packers providing an upper guard interval and a lower guard interval; a sampling region provided between the upper and the lower guard intervals when the one or more expandable packers are expanded into abutting contact with the wellbore wall; and a sampling flowline in fluid communication with the sampling region for drawing the fluid from the sampling region.

An embodiment of a method for obtaining a fluid sample at a position in a wellbore that penetrates a subterranean formation includes the steps of disposing a sampling tool equipped with a packer into the wellbore on a conveyance; expanding the packer to form a sampling region between an upper guard interval and a lower guard interval; drawing fluid from the upper guard interval and the lower guard interval; and drawing fluid from the sampling region.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus comprising:

an expandable packer configured to be disposed in the wellbore on a conveyance and expandable to fluidly isolate sections of a wellbore;

an upper cleanup port configured to receive formation fluid into the apparatus;

a lower cleanup port configured to receive formation fluid into the apparatus;

a sampling inlet positioned between the upper cleanup port and the lower cleanup port and configured to receive formation fluid into the apparatus, wherein at least one of the upper cleanup port, the lower cleanup port and the sampling inlet is formed within a body of the expandable packer and further wherein a portion of the expandable packer fluidly separates either the upper cleanup port from the sampling inlet or the lower cleanup port from the sampling inlet.

2. The apparatus of claim 1 wherein the sampling inlet is provided between an upper sampling packer section and a lower sampling packer section.

3. The apparatus of claim 2 wherein the upper and lower sampling packer sections are part of the expandable packer.

4. The apparatus of claim 1 wherein the sampling inlet, the upper cleanup port and the lower cleanup port are in fluid communication with a hydrocarbon reservoir if the expandable packer is expanded.

5. The apparatus of claim 1 wherein the conveyance comprises one of a wireline, a drill string, and a tubing.

6. An apparatus for obtaining a fluid at a position within a wellbore that penetrates a subterranean formation, comprising:

a body adapted to be disposed in the wellbore on a conveyance equipped with one or more expandable packers providing a sample region disposed between an upper cleanup zone and a lower cleanup zone when expanded into abutting contact with the wellbore wall;

an upper cleanup port provided at the upper cleanup zone;

a lower cleanup port provided at the lower cleanup zone;

at least one fluid cleanup flowline in fluid connection with the upper and lower cleanup ports;

a sampling inlet provided at the sampling region; and a sampling flowline in fluid connection with the sampling inlet for drawing fluid from the sampling region wherein the one or more packers consists of one packer.

7. A formation fluid sampling tool comprising:

an expandable packer having a sampling region positioned within a body of the packer and between a first section of the packer and a second section of the packer, the sampling region comprising a sampling inlet in fluid communication with a reservoir if the packer is expanded and a cleanup port positioned a vertical distance above or below the sampling region and fluidly isolated from the sampling inlet by the first section or the second section of the packer, the cleanup port configured to receive fluid from the reservoir.

8. The tool of claim 7 wherein: the cleanup port is positioned within the body of the packer.

9. The tool of claim 8 further comprising a second cleanup port positioned within the body of the packer and in fluid communication with the reservoir if the packer is expanded.

10. The tool of claim 9 wherein the cleanup port is fluidly isolated from the sampling inlet by the first section of the packer and the second cleanup port is fluidly isolated from the sampling inlet by the second section of the packer.

11. The tool of claim 7 wherein the packer is conveyed one of a wireline, a drill string, and a tubing.

12. A method comprising:

disposing a sampling tool equipped with a packer into the wellbore on a conveyance;

expanding the packer to form a sampling region between an upper guard interval and a lower guard interval;

drawing fluid from the upper and lower guard intervals; and drawing fluid from the sampling region, wherein at least two of the upper guard interval, the lower guard interval and the sampling region are fluidly isolated from each other by one or more sections of the packer.

13. The method of claim 12 wherein the packer comprises an upper packer and a lower packer.

14. The method of claim 13 wherein the packer further comprises a middle packer disposed between the upper and lower packers.

15. The method of claim 12 wherein:

the upper guard interval comprises an upper cleanup zone formed between an upper guard packer section and an upper sampling packer section;

the lower guard interval comprises a lower cleanup zone formed between a lower sample packer section and a lower guard packer section; and the sampling region is formed between the upper and the lower sampling packer sections.

16. The method of claim 15 wherein the packer comprises an upper and a lower packer.

17. The method of claim 16 wherein the packer further comprises a middle packer disposed between the upper and lower packers.

18. The method of claim 12 wherein the conveyance comprises one of a wireline, a drill string, and a tubing.

* * * * *